United States Patent [19]

Smith, deceased et al.

[11] Patent Number: 4,835,353

[45] Date of Patent: May 30, 1989

[54] FILAMENT POWER CONPENSATION FOR MAGNETRON

[75] Inventors: Peter H. Smith, deceased, late of Anchorage, Ky., by Pamela Sheila Smith, executor; Thomas R. Payne; Flavian Reising, Jr., both of Louisville, all of Ky.

[73] Assignee: General Electric Company, Louisville, Ky.

[21] Appl. No.: 138,136

[22] Filed: Dec. 28, 1987

[51] Int. Cl.[4] ..... H05B 6/68

[52] U.S. Cl. ..... 219/10.55 B; 363/98; 363/132; 315/105

[58] Field of Search ..... 363/17, 75, 82, 90, 363/91, 93, 98, 132; 219/10.55 B; 315/102, 105, 106, 107

[56] References Cited

U.S. PATENT DOCUMENTS

| | | | |
|---|---|---|---|
| Re. 31,146 | 2/1983 | Gyursanszky . | |
| 3,258,676 | 6/1966 | Du Puy | 363/91 |
| 3,396,342 | 8/1968 | Feinberg . | |
| 3,760,291 | 9/1973 | Levinson | 219/10.55 B |
| 4,171,514 | 10/1979 | Faxon . | |
| 4,194,160 | 3/1980 | Loucks . | |
| 4,318,165 | 3/1982 | Kornrumpf et al. . | |
| 4,353,009 | 10/1982 | Knoll . | |
| 4,370,600 | 1/1983 | Zansky . | |
| 4,593,167 | 6/1986 | Nilssen . | |
| 4,672,159 | 6/1987 | Nilssen . | |
| 4,680,506 | 7/1987 | Nilssen . | |

*Primary Examiner*—Peter S. Wong

*Attorney, Agent, or Firm*—H. Neil Houser; Radford M. Reams

[57] ABSTRACT

An arrangement for providing power to a cooking magnetron uses a full wave bridge inverter circuit connected to a power transformer. The filament of the magnetron is energized by a secondary winding of the power transformer. The inverter controls the microwave output of the magnetron by duty cycle control. In order to stabilize filament power against variations due to changes in the inverter duty cycle, a saturable reactor is connected in series with the filament. The reactor has a control winding which changes the impedance of the reactor in order to compensate for variations in the power supplied by the power transformer. The control winding of the reactor may be supplied with a voltage dependent upon the magnetron current. Since the magnetron current depends on the duty cycle of the inverter, this voltage may be used to make the impedance of the reactor dependent upon the duty cycle.

16 Claims, 4 Drawing Sheets

FILAMENT POWER CONPENSATION FOR MAGNETRON

CROSS-REFERENCE TO RELATED APPLICATIONS

This application discloses and claims subject matter related to subject matter disclosed and claimed in the following related applications, which applications are filed concurrently herewith and are hereby incorporated by reference:

"MAGNETRON WITH FULL WAVE BRIDGE INVERTER", Ser. No. 138,138;

"MAGNETRON WITH TEMPERATURE PROBE ISOLATION", Ser. No. 138,714;

"MAGNETRON WITH FREQUENCY CONTROL FOR POWER REGULATION", Ser. No. 138,135;

"MAGNETRON WITH MICROPROCESSOR POWER CONTROL", Ser. No. 138,137; and

"MAGNETRON WITH MICROPROCESSOR BASED FEEDBACK CONTROL", Ser. No. 138,139.

These applications, which were filed in the name of Peter Smith except that "COOKING MAGNETRON WITH FREQUENCY CONTROL FOR POWER REGULATION" names Peter Smith and Flavian Reising, Jr. as co-inventors, are assigned to the Assignee of the present application.

BACKGROUND OF THE INVENTION

This invention relates generally to a cooking magnetron power supply system and, more particularly, to such a system wherein magnetron filament power is stabilized.

Most microwave ovens presently on the market use a 50 or 60 Hz LC power supply system along the lines described in U.S. Pat. No. 3,396,342 Feinberg issued on Aug. 6, 1968. This type of power supply, which is used in microwave cooking appliances from low power subcompacts to combination electric range/microwave units, has existed for over twenty years.

Among the advantages of the Feinberg power supply system are the simplicity of using only four components and good control of the power factor. Disadvantages include the bulk (weight and size) need for controlling the power by the duty cycle only, noncontinuous filament power at power levels other than 100%, high in-rush current and lamination noise. The bulk disadvantage of the Feinberg system results from the requirement for a 50 or 60 Hz transformer rating of about 1.2 KVA. Iron and copper weight of such a transformer typically weighs about 700 grams and occupies a volume of 1710 cubic centimeters. Additionally, a physically large capacitor is required as a necessary component when using such a transformer in order to provide constant current regulation of magnetron power against variations in line voltage.

A push-pull system has been used or proposed in connection with powering a cooking magnetron. Although the push-pull system avoids some of the disadvantages of the Feinberg power supply arrangement, such a push-pull system has included disadvantages such as high cost, complex logic, high voltage Darlington connected power transistors, reactive (i.e., power dissipative) snubber networks, inherent unbalance in volt second characteristics for each half cycle of operation being caused by uncontrolled turned-off characteristics of switching transistors, poor input power factor (for example, 0.6), high EMI generation, poor conversion, and higher cost magnetics. The higher cost magnetics corresponds to a design having a variable leakage transformer as a means of power control.

The powering of the magnetron filament has presented some design problems in magnetron power systems. In particular, some magnetron power systems may result in undesirable power changes in the filament of the magnetron. More specifically, designs which have an arrangement for adjusting the output power of the magnetron itself (i.e., the microwave output due to power applied to the anode and cathode of the magnetron) may inadvertently change the power applied to the filament of the magnetron. Depending upon the technique used for controlling the magnetron power, the power in the filament of the magnetron may fluctuate over an undesirably wide range.

Accordingly, it is a principle object of the invention to provide a microwave energy generating system having a power supply wherein the magnetron filament is stabilized against fluctuations in its power applied to the magnetron.

A more specific object of the present invention is to provide a microwave energy generating system wherein the filament power is stabilized against changes which would otherwise occur as a result of an adjustment of the microwave output of the magnetron.

SUMMARY OF THE INVENTION

The present invention involves a cooking magnetron powered by a power transformer which has a primary winding connected to an AC power source and a high voltage magnetron powering secondary winding coupled across the anode and cathode of the magnetron to energize the magnetron. The power transformer also includes a low voltage secondary winding, or filament winding, connected to supply power to the filament of the magnetron. An important feature of the present invention involves the use of sensing means for sensing a change in power supplied to the primary winding. A variable impedance means, preferably a reactor, is operatively connected in the filament winding circuit to stabilize the filament power by changing impedance in response to the sensing means. Preferably, the reactor is connected in series with the filament. The AC source is a full wave full bridge inverter having a variable duty cycle to control the power supply to the primary. The reactor stabilizes the power supplied to the filament against variations in the duty cycle of the inverter.

In one embodiment of the present invention, the sensing means is a sensing resistor connected in the high voltage magnetron powering secondary circuit magnetron. A voltage proportional to magnetron current appears across this reactor. The voltage is applied to a control winding of the reactor to control the impedance of the controlled winding of the reactor connected in series with the filament.

BRIEF DESCRIPTION OF THE DRAWINGS

The above and other objects and features of the present invention will become more apparent when the following detailed description is considered in conjunction with the accompanying drawings wherein like characters represent like parts throughout the several views and in which.

DETAILED DESCRIPTION

Overview

Figure 1:
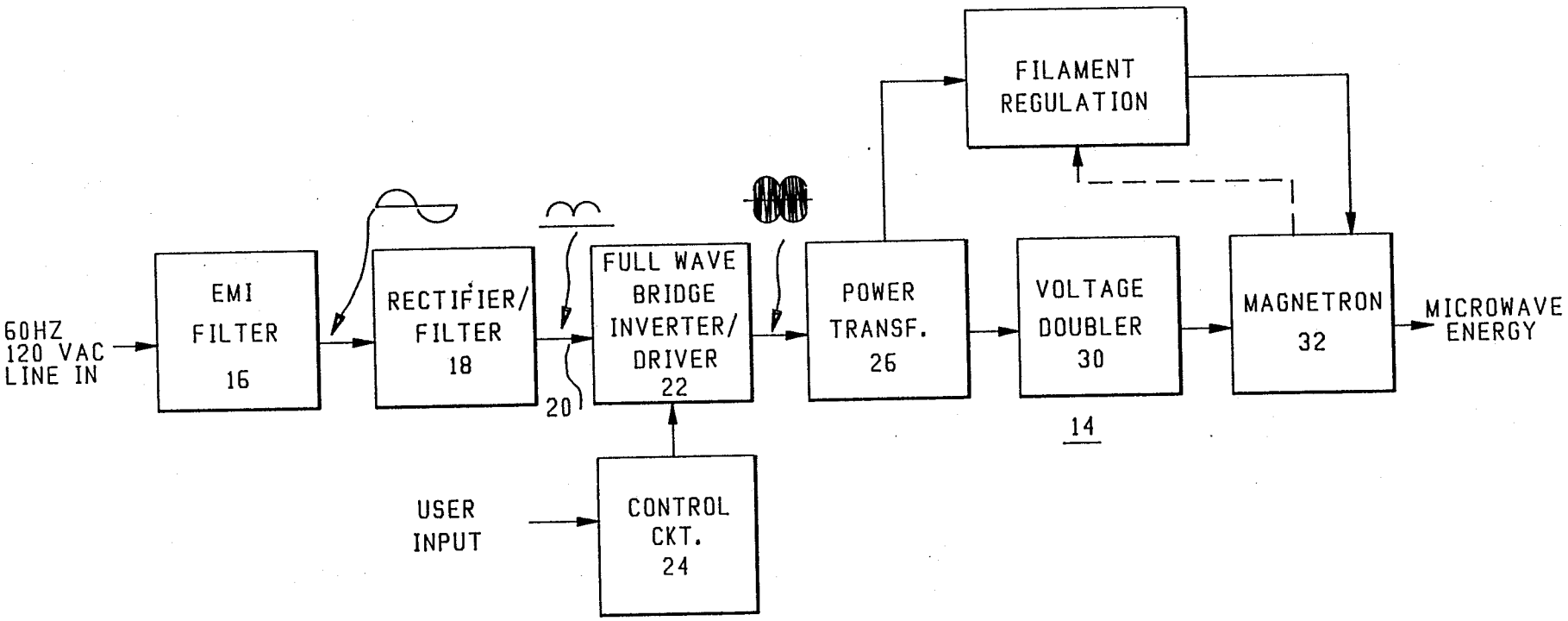
FIG. 1 shows a functional block diagram of the present microwave oven power supply system.

In the block diagram of FIG. 1, the microwave energy generating system 14 includes an electromagnetic interference (EMI) filter 16 connected to a standard AC line. The filter 16 prevents the system 14 from transmitting troublesome signals to the AC line. The EMI filter 16 is connected to a rectifier/filter 18. As shown, the output of the rectifier/filter 18 on line 20 is a bulk DC signal, meaning that it has a substantial ripple resulting from the 60 Hz coming into the system 14.

The bulk DC on line 20 is supplied to a full wave bridge inverter/driver 22. The inverter/driver 22, which is under the control of control circuit 24, supplies high voltage AC at a frequency of about 25 KHz to a power transformer 26. The control circuit 24 may receive user inputs with respect to power setting, time of operation, and other conditions commonly set by consumers when operating a microwave oven. As shown, the control circuit 24 is connected to the power transformer 26. As will be discussed in more detail below, the control circuit 24 receives a feedback signal from the power transformer 26.

The power transformer 26 supplies energy to a voltage doubler circuit 30 which in turn powers the magnetron 32. The magnetron 32 also receives current for its filament from the power transformer 26.

As will be hereinafter described in greater detail, the magnetron filament is energized by a filament winding wound on the same power transformer core as the high voltage magnetron powering secondary winding. In order to maintain relatively constant power to the filament in accordance with the present invention filament regulation circuitry 28 is provided. Filament regulation circuit 28 senses changes to the power applied to the primary of the power transformer by sensing variations in power applied to the magnetron. Regulation circuit 28 is effective to adjust current to the filament as required to maintain the desired filament power.

Inverter and Associated Circuitry

Figure 2:
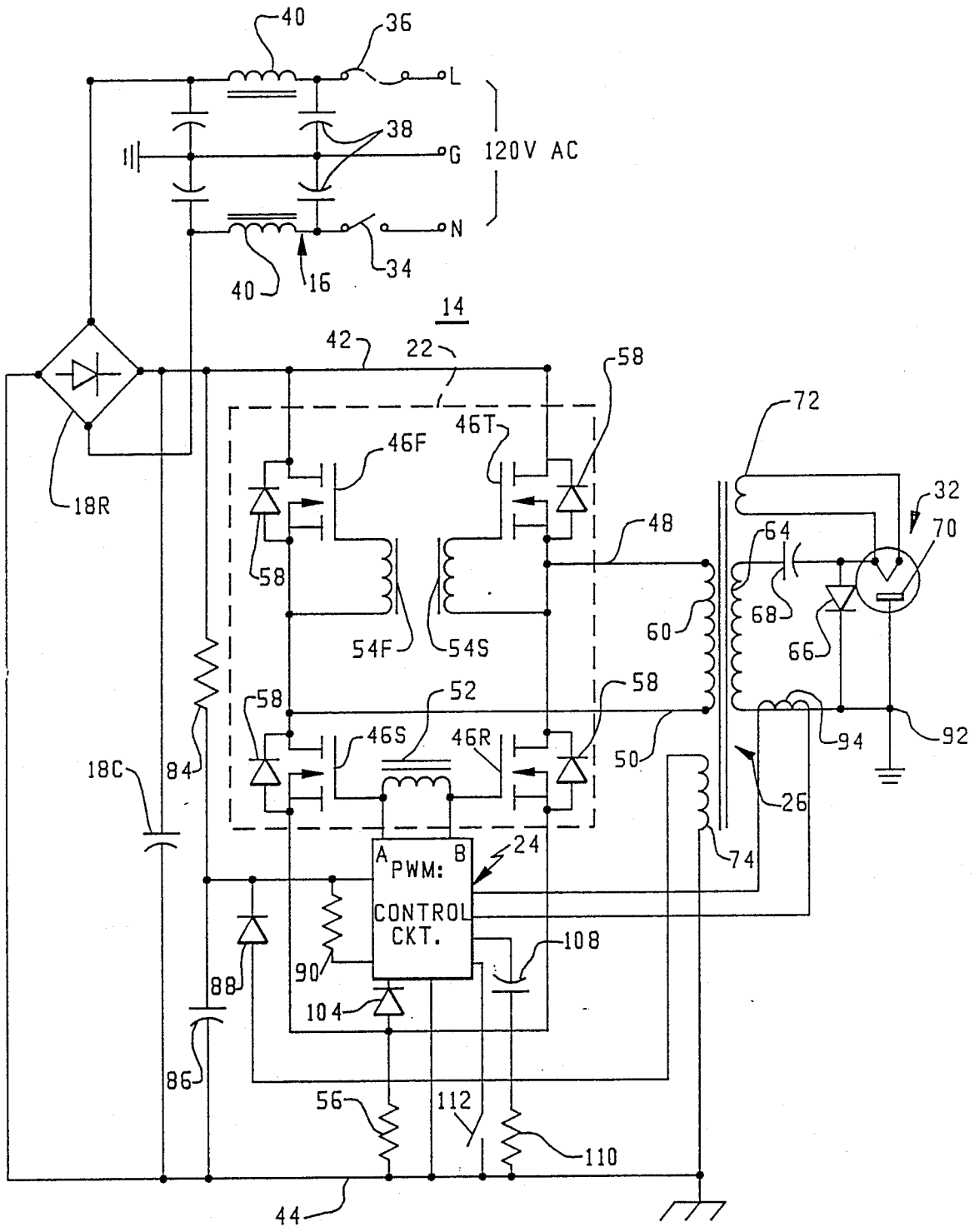
FIG. 2 shows a simplified schematic circuit diagram of the present system.

As shown in FIG. 2, the EMI filter 16 of the microwave generating system 14 receives 120 volts by way of power relay contacts 34 and fuse 36. The EMI filter 16 is a double pi filter comprising capacitors 38 and inductors 40. The signal from the filter 16 is supplied to the bridge rectifier 18R which supplies a rectified signal to lines 42 and 44. The signal is filtered by a filter capacitor 18C such that the signal across lines 42 and 44 is a bulk DC signal. Using a filter capacitor of 30 microfarads, 250 volt DC, the signal across lines 42 and 44 would vary in amplitude between 30 and 165 volts. Thus, the ripple or variation in amplitude resulting from the input AC signal is at least as great as the normal minimum voltage during operation of 30 volts. By operating the system 14 from bulk DC, one avoids the need for a high capacitance value capacitor for filter capacitor 18C. Use of a sufficiently high value capacitor as a filter would improve the smoothness of the DC signal across lines 42 and 44, but it would draw a very high current initially such that the fuse 36 and/or a circuit breaker in the user's household circuitry might be triggered.

The inverter/driver 22 includes first, second, third, and fourth transistors 46F, 46S, 46T, and 46R. The transistors serve as semiconductor switches for switching the bulk DC across inverter input lines 42 and 44 to the inverter output lines 48 and 50. The switches 46F, 46S, 46T, and 46R are switched on and off by control circuit 24. In the illustrative embodiment, the switches are 270 volt 18A power FETs which are commercially available from International Rectifier under the designation IRF 640 power FETs.

The control circuit 24 is directly connected to the control terminals of semiconductor switches 46S and 46R. (For the MOSFETs shown, the control terminal will of course be the gate.) Additionally, the control circuit 24 controls the MOSFET switches 46F and 46T by way of an isolation transformer having a primary winding 52 and secondary windings 54F and 54S. The isolation transformer serves as an isolated drive circuit to allow the control terminals (more specifically gates) of switches 46F and 46T to float relative to the switches 46S and 46R. The isolation transformer, having primary 52 and secondary 54F and 54S, is a simple 1:1:1 pulse transformer. The drains of semiconductor switches 46F and 46T directly contact the inverter input line 42 and, therefore, may be considered as input terminals to those switches, whereas the source terminals of switches 46F and 46T may be considered as output terminals as they directly contact the respective inverter output lines 50 and 48. On the other hand, the sources of transistors 46S and 46R serve as input terminals in that they receive the input from inverter input line 44 by way of resistor 56, whereas the drains of switches 46S and 46R serve as output terminals in that they respectively connect to inverter output lines 50 and 48.

Each of the switches 46F, 46S, 46T, and 46R has a diode 58 connected in parallel with it. The diodes 58 prevent the transistor switches from burning out during the momentary deadband between turn off of one pair of switches and turn on of another pair of switches.

The inverter output lines 48 and 50 are connected to a primary winding 60 of a power transformer 26. The turns ratio between the primary 60 and a magnetron powering high voltage secondary winding 64 is established to provide a 2,000 volt square wave across the secondary winding when loaded to draw an average current of 540 mA. This voltage is half wave doubled by diode 66 and charge holding capacitor 68. The resulting negative going 4,000 volt square wave is applied to the cathode of the cooking magnetron 70. Typically, the power transformer 26 may have a primary winding 60 with 24 turns and a high voltage secondary winding 64 having 440 turns. Additionally, a low voltage one turn secondary winding 72 provides the required 3 volts at 14 amps (RMS) for the filament of magnetron 70 and a 2 turn secondary winding 74 provides low voltage power to operate the control circuit 24.

Basic Inverter and Control Circuit Operation

Continuing to view FIG. 2, but also considering the waveform diagram of FIG. 3, the basic operation of the inverter 22 will be explained. The control circuit 24, which is discussed in detail below, may be used to provide different power levels to the magnetron 70. Parts (a)-(f) of FIG. 3 relate to a low power 20% operation, whereas parts (g)–(l) relate to a high power 100% operation of the magnetron.

Figure 3:
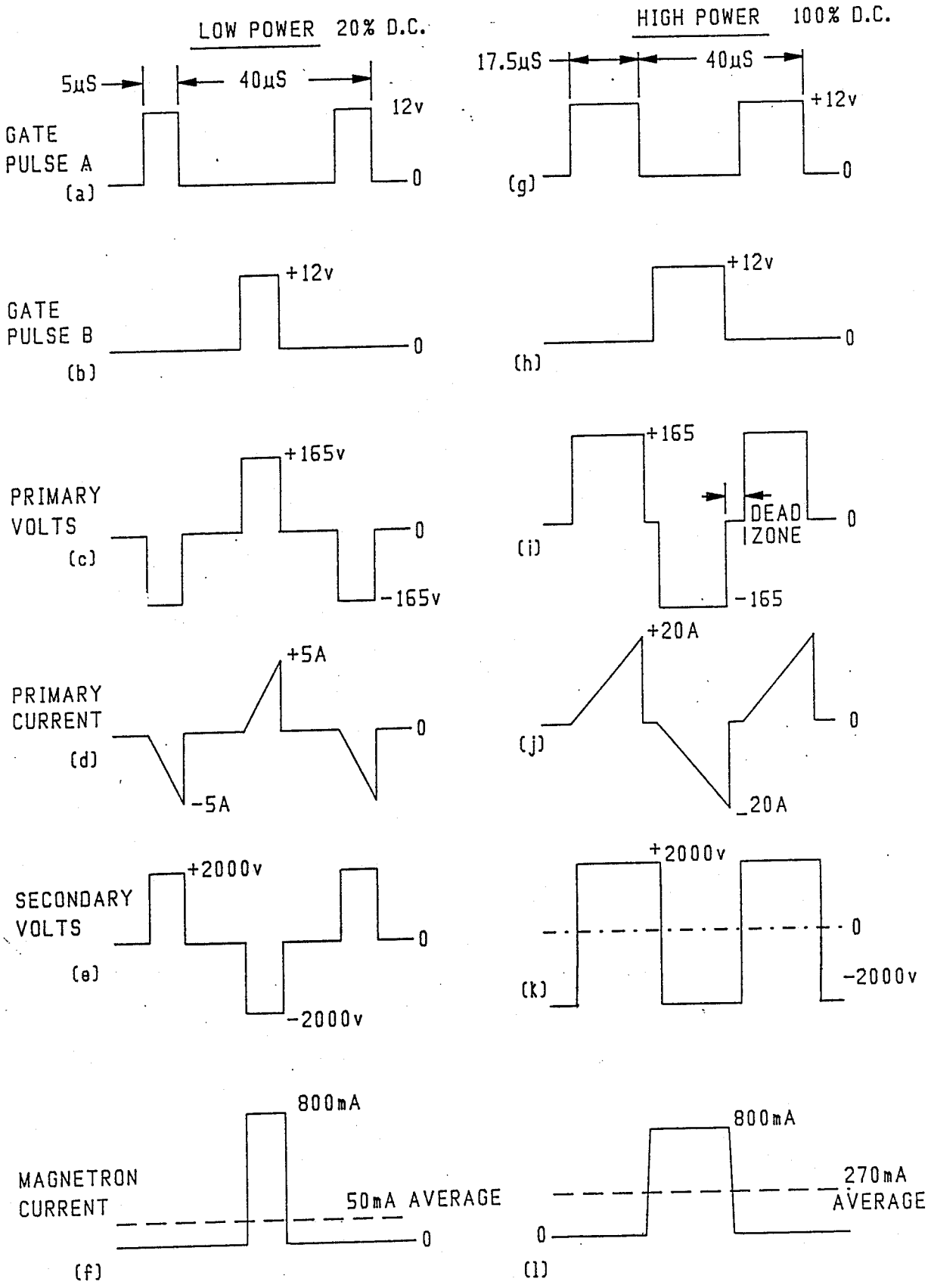
FIG. 3 is a time diagram of waveforms generated at different parts of the present system.

Taking first the low power operation, the control circuit 24 generates a gate pulse shown at part (a) of FIG. 3, which gate pulse appears at output A of control circuit 24 in FIG. 2. The gate pulse turns on or closes the transistor switch 46S and, by way of primary 52 and secondary 54S, closes the switch 46T. The control circuit 24 controls the power supplied to the magnetron 70 by controlling the width of the pulse. In part (a) of FIG. 3, the pulse is 5 microseconds wide. The frequency of the pulses is constant and the gate pulses A are generated repetitively during a series of first time intervals starting every 40 microseconds. Interspersed with the first time intervals, a series of gate pulses B (only one is shown in part (b) for ease of illustration) are generated at output B of control circuit 24. The gate pulse B closes the switches 46F and 46R. As shown in part (c) of FIG. 3, the alternate closing of pairs of the switches (46S and 46T together and, 46F and 46R together) applies the bulk D.C. (up to 165 volts peak) in alternate directions to the primary 60 of power transformer 26. The current in primary 60 is represented in part (d) of FIG. 3, whereas the voltage across secondary 64 is shown in part (e). The resulting magnetron current of approximately 800 mA is shown in part (f) of FIG. 3.

The operation of the circuitry as shown in parts (g)–(l) of FIG. 3 is essentially identical to that of parts (a)–(f) of FIG. 3 except that the gate pulses A and B are greater in width, which in turn increases the width in all of the related waveform pulses. This corresponds to a greater time during which the current of 800 mA is applied to the magnetron as shown in part (l) of FIG. 3. Accordingly, an average of 270 mA is applied during high power operation, whereas the average is only 50 mA for low power operation.

It should be noted that, even in the high power operation of FIG. 3 parts (g)–(l), there should be a short dead zone between the end of one of the gate pulses at output A or output B and the beginning of the gate pulse at the alternate output. The existance of this "dead zone" is best illustrated in part i of FIG. 3, it being understood that this dead zone represents the delay from the end of gate pulse B to the beginning of gate pulse A. Typically, this delay might be 2.5 microseconds for a total dead zone of 5 microseconds considering also the corresponding delay between the end of gate pulse A and the beginning of gate pulse B.

Control circuit 24 is described in greater detail in U.S. patent application Ser. No. 138,138 incorporated by reference above.

Filament Power Compensation

In conventional 60 Hz LC power supply systems for oven magnetrons, the magnetron filament winding is often wound on the same core as the high voltage winding. Accordingly, the filament winding is energized when the LC power supply fransformer primary is energized and de-energized when the primary is deenergized. Thus, the filament can cool down during the OFF intervals of the duty cycle, which can be on the order of 15–30 seconds in duration. Approximately three seconds are required to raise the cathode to full operating temperature when starting with a cold cathode. During this period, the magnetron can oscillate at an incorrect mode or may jump in and out of odd modes, especially when starting from a cold cathode. When the magnetron jumps into and out of an odd mode, the oscillation often ceases, which usually causes very high voltage transients to develop (typically 12 to 14 kilovolts).

The present system avoids the potentially long OFF intervals typical of 60 Hz power supply duty cycle control arrangements. Thus, the magnetron cathode remains at almost constant temperature which improves the magnetron tube life and eliminates the problem of periodically generated high voltage transients.

The present system is unlike some prior art systems in which a separate filament transformer is placed in parallel with the main power transformer to provide constant filament voltage (except for variations in filament voltage caused by line variations). In the present system, as the pulse width is varied to adjust the magnetron power as herein before described with reference to FIG. 3, power applied to the filament via winding 72 (FIG. 2) may also change.

Therefore, it is desirable to regulate the filament voltage, current, and/or power against changes which would otherwise occur in response to such pulse width variations.

Figure 4:
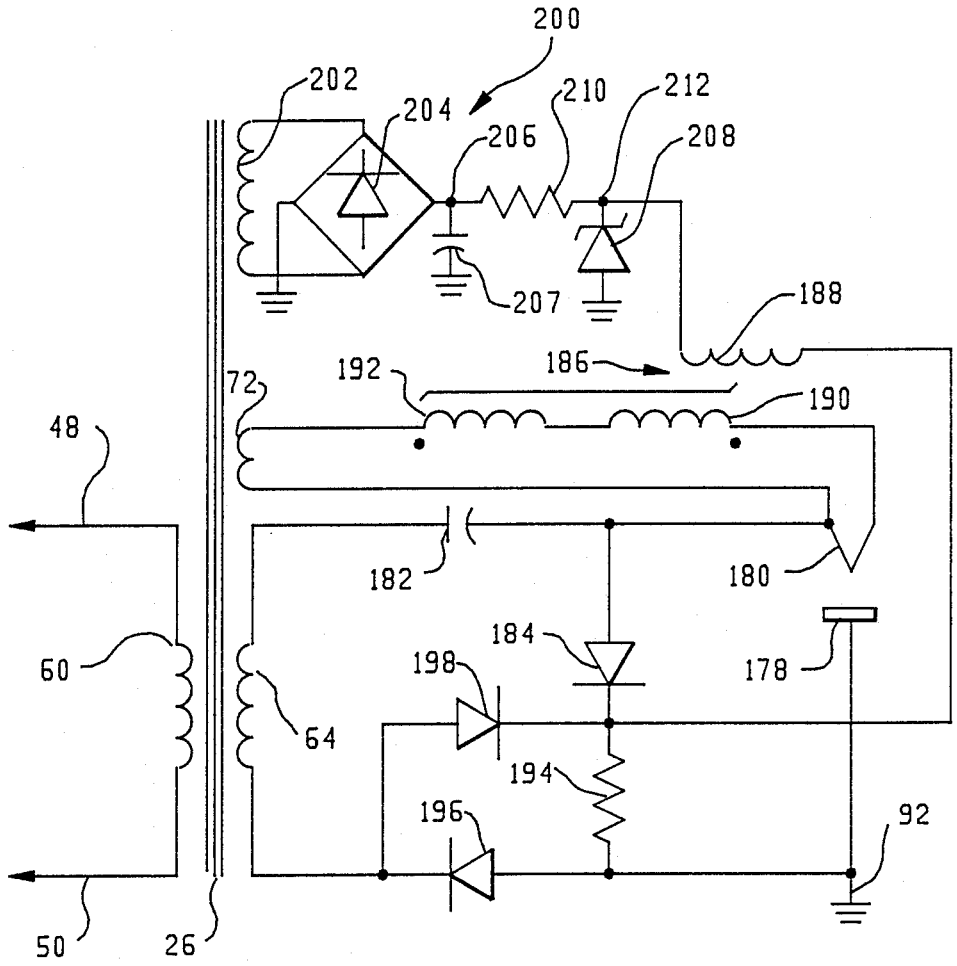
FIG. 4 shows a portion of the schematic of FIG. 2 to which has been added circuitry illustrative or embodying an arrangement for regulating filament power in accordance with the present invention.

FIG. 4 shows a first embodiment of an arrangement in accordance with the present invention for regulating power to the filament against changes which would otherwise occur as the pulse width is varied. The primary winding 60 of power transformer 26 is connected to inverter output lines 48 and 50. The connections to these lines 48 and 50 would be the same as the connections shown in FIG. 2, it being understood that FIG. 4 shows the addition of magnetron filament regulation circuitry to the secondary side of the power transformer circuit of FIG. 2. It should also be noted that the additional secondary winding 74 in FIG. 2 has been omitted from FIG. 4 in the interest of clarity.

In FIG. 4, it will readily appreciated that the capacitor 182 and diode 184 serve to halfwave double the voltage in essentially the same fashion as capacitor 68 and diode 66 of FIG. 2.

In accordance with the present invention, a controlled variable impedance means is operatively connected in the filament power circuit between the low voltage filament secondary winding 72 of the main power transformer 26 and the magnetron filament to stabilize filament power. The impedance of the variable impedance means changes in response to a control signal generated by sensing means which senses a change in the power supplied to the primary winding of the power transformer. (As used herein, a "controlled variable impedance" has at least one control terminal to control the impedance across two other terminals.)

In the illustrative embodiment, the controlled variable impedance means is provided in the form of a small saturable core reactor 186 comprising a small E/I core on which are wound a control winding 188 and two controlled windings 190 and 192.

The core has two outer magnetic paths and a center path. The controlled windings 190 and 192 are oppositely wound on respective outer paths. The control winding 188 is wound on the inner path. A reactor having a controlled winding inductance which varies from approximately 150 microhenries with no current in the control winding to approximately 50 microhenries with a control winding current of approximately 60 milliamps, for a 3:1 control ratio, would be suitable for use in the circuit of the illustrative embodiment. (The filament is primarily a resistive load such that control of the current essentially controls voltage as well.)

Sensing means for sensing changes in power applied to the primary 60 of transformer 26 in the illustrative embodiment is provided in the form of sensing resistor 194 serially connected between the cathode of diode 184 and magnetron anode ground 92. Diodes 196 and 198 are connected to provide a current path through resistor 194 for the charging current and discharging current respectively for capacitor 182. The voltage at the junction of diode 184 and resistor 194 is proportional to the magnetron current which is a direct function of the power applied to primary 60. Thus, a voltage which is representative of the power applied to primary 60 is developed at the junction of diode 184 and resistor 194. This voltage serves as the control voltage for reactor 186.

To this end, one side designated the control terminal of control winding 188 of reactor 186 is connected to the junction of diode 184 and resistor 194. The other side or terminal is connected to a reference supply voltage circuit 200. Reference supply circuit 200 is energized by a low voltage secondary winding 202 of power transformer 26. A full wave rectifier circuit 204 connected across secondary winding 202 provides a pulsating DC voltage at 206 filtered by filter capacitor 207. This voltage is coupled to one side of a zener diode 208 by current limiting resistor 210. The other side of zener diode 208 is connected to magnetron anode ground. Zener diode 208 limits the voltage at 212 to the zener voltage thereby providing an essentially constant reference voltage which is applied to the other side of control winding 188.

By this arrangement, the voltage across the control winding 188 which determines the inductance of the controlled windings 190 and 192 is the difference between the control voltage at the junction of diode 184 and sensing resistor 194 and the reference voltage at 212. The value of resistor 194 and the zener voltage level are selected to limit the control voltage to a range of values not exceeding the reference voltage over the desired range of magnetron current. Since the voltage applied to the control terminal of winding 188 is always less than or equal to the reference voltage, and since it varies directly with magnetron current, the voltage across the control winding 188 and consequently the current through winding 188 varies inversely with magnetron current.

As described with reference to FIG. 3, the power applied to primary winding 60 is varied by varying the pulse width of pulses applied to the primary by the inverter circuit 22 (FIG. 2). As the pulse width increases, the magnetron current increases. As the magnetron current increases, the voltage at the junction of resistor 194 and diode 184 increases proportionally. This decreases the voltage differential across control winding 188, proportionally increasing the impedance of the controlled windings 190 and 192 in series with the magnetron filament, thereby reducing the filament current. Since the filament is essentially a resistive element, the reduction in current proportionally reduces the filament power. Similarly, a decrease in the power applied to the primary, such as by reducing the width of the pulses applied to the primary, reduces the magnetron current. The control voltage is reduced proportionally, increasing the voltage differential across control winding 188. This increase in control winding voltage lowers the impedance of controlled windings 190 and 192 thereby increasing the power applied to the filament.

By this arrangement, the characteristics of the reactor 186 help to stabilize filament voltage against changes which would otherwise occur as the pulse width applied to primary 60 is varied. More particularly, the operation of the reactor 186 counteracts the tendency of pulse width changes to change the filament voltage. The proper selection of values for resistor 194 together with the winding turns ratio of series reactor 186 produces the desired magnetron current to filament current ratio.

Although various specific circuit values, constructions, and other details have been disclosed herein, it is to be appreciated that these are for illustrative purposes only. Various modifications and adaptations will be readily apparent to those of skill in the art. Accordingly, it is understood that the appended claims are intended to cover all such modifications and changes as fall within the true spirit and scope of the invention.

What is claimed is:

1. A microwave energy generating system comprising:

an AC power source;

a magnetron operable to generate microwave energy for cooking, said magnetron including an anode, a cathode, and a filament;

a power transformer having a primary winding, a high voltage magnetron powering secondary winding, and a low voltage filament powering secondary winding, said magnetron powering secondary winding operatively connected across said anode and said cathode to supply power to said magnetron, said filament powering secondary winding operatively connected to supply power to said filament, said primary winding receiving power from said AC power source;

sensing means for sensing a change in power supplied to said primary winding; and a controlled variable impedance means operatively connected between said filament powering secondary winding and said filament to stabilize filament power by changing impedance in response to said sensing means.

2. The microwave energy generating system of claim 1 wherein said variable impedance means is in series with said filament.

3. The microwave energy generating system of claim 2 wherein said variable impedance means is a saturable reactor.

4. The microwave energy generating system of claim 1 wherein said AC power source is a full wave full bridge inverter having a variable duty cycle to control the power supplied to said primary winding, and said variable impedance means stabilizes filament power against changes from variations in the duty cycle of said inverter.

5. The microwave energy generating system of claim 1 wherein said sensing means is a sensing resistor operatively connected in circuit with said magnetron powering secondary winding and said magnetron, said sensing resistor supplying a voltage proportional to magnetron current to said variable impedance means.

6. The microwave energy generating system of claim 5 wherein said variable impedance means is a saturable reactor having a control winding and at least one controlled winding, said controlled winding connected in series with said filament, said control winding having first and second terminals, said first terminal connected to receive said voltage proportional to magnetron current, and said second terminal connected to a reference voltage.

7. The microwave energy generating system of claim 6 further comprising a capacitor and a diode both connected in circuit with said magnetron powering secondary winding for half wave doubling of voltage from said magnetron powering secondary winding, and wherein said sensing resistor is connected in series with said diode.

8. The microwave energy generating system of claim 5 wherein said AC power source is a full wave full bridge inverter having a variable duty cycle to control the power supplied to said primary winding, and said variable impedance means stabilizes filament power against changes from variations in the duty cycle of said inverter.

9. A method of powering a cooking magnetron comprising the steps of:

supplying AC power to a primary winding of a power transformer;

supplying power to an anode and a cathode of the magnetron from a magnetron powering secondary winding of the power transformer;

supplying power to a filament of the magnetron from the power transformer;

sensing a condition corresponding to a change in power supplied to the primary winding; and stabilizing filament power by changing the impedance of a controlled variable impedance means connected in power dividing relationship with said filament in response to said sensed condition.

10. The method of claim 9 wherein said step of supplying power to the filament uses power from a filament powering secondary winding of the power transformer.

11. The method of claim 9 wherein the AC power is supplied to the primary winding by a full wave full bridge inverter, and further comprising the steps of changing the duty cycle of the inverter to control microwave output of the magnetron, and wherein the step of stabilizing filament power stabilizes filament power against changes due to duty cycle changes.

12. The method of claim 9 wherein the controlled variable impedance means is connected in series with the filament, and said step of stabilizing filament power involves increasing the impedance of the controlled variable impedance means for a sensed condition corresponding to an increase in power supplied to the primary winding and decreasing the impedance of the controlled variable impedance means for a sensed condition corresponding to a decrease in power supplied to the primary winding.

13. The method of claim 12 wherein said step of sensing is sensing a voltage proportional to the magnetron current.

14. A method of powering a cooking magnetron comprising the steps of:

supplying AC power to a primary winding of a power transformer from a full wave full bridge inverter;

supplying power to an anode and a cathode of the magnetron from a magnetron powering secondary winding of the power transformer;

supplying power to a filament of the magnetron from the power transformer;

changing the duty cycle of the inverter to control microwave power of the magnetron; and stabilizing filament power by changing the impedance of a controlled variable impedance means connected in power dividing relationship with said filament, the impedance of the controlled variable impedance means changing dependent on the duty cycle of the inverter.

15. The method of claim 14 further comprising the step of sensing a voltage proportional to the magnetron current and wherein the impedance of the variable impedance means changes due to sensed changes in the magnetron current, which magnetron current depends on the duty cycle of the inverter.

16. The method of claim 14 wherein the controlled variable impedance means is a saturable reactor connected in series with the filament, and the stabilizing step involves increasing the impedance of the reactor for an increase in duty cycle of the inverter and decreasing the impedance of the reactor for a decrease in duty cycle of the inverter.

* * * * *